US006659775B1

(12) United States Patent
Moy

(10) Patent No.: US 6,659,775 B1
(45) Date of Patent: Dec. 9, 2003

(54) GOLF TRAINING SYSTEM

(76) Inventor: Gerard Earl Moy, 1608 Danube La., Plano, TX (US) 75075

( * ) Notice: Subject to any disclaimer, the term of this patent is extended or adjusted under 35 U.S.C. 154(b) by 0 days.

(21) Appl. No.: 10/078,040

(22) Filed: Feb. 19, 2002

Related U.S. Application Data

(60) Provisional application No. 60/270,026, filed on Feb. 20, 2001.

(51) Int. Cl.[7] ..... A63B 69/36

(52) U.S. Cl. ..... 434/252; 473/387; 473/236

(58) Field of Search ..... 473/387, 388, 473/389, 390, 391, 392, 396, 401, 403, 236, 237, 257; 434/247, 252

(56) References Cited

U.S. PATENT DOCUMENTS

| | | | | |
|---|---|---|---|---|
| 2,693,358 | A | * 11/1954 | Dawson | 473/398 |
| 5,120,064 | A | 6/1992 | Cerami | |
| 5,142,309 | A | 8/1992 | Lee | |
| 5,386,997 | A | 2/1995 | Smith | |
| 5,417,427 | A | 5/1995 | Doane | |
| 5,609,530 | A | 3/1997 | Butler, Jr. | |
| 5,702,309 | A | 12/1997 | Lee | |
| 5,782,701 | A | 7/1998 | O'Bryan | |
| 5,836,829 | A | 11/1998 | Van Cott | |
| 5,860,871 | A | 1/1999 | Marley, Jr. | |
| 5,984,799 | A | 11/1999 | Romano | |
| 6,110,060 | A | 8/2000 | Spoto | |
| 6,309,315 | B1 | 10/2001 | Adams | |
| 6,312,344 | B1 | 11/2001 | Smith | |
| 2001/0031666 | A1 | 10/2001 | Knecht | |

OTHER PUBLICATIONS

Golftek, Inc., 725 29th St. N., #C, Lewiston, Idaho 83501, Golftek "PRO III Golf Swing Analyzer" sales brochure.

MacNeill Engineering Worldwide, P.O. Box 735, 289 Elm Street, Marlborough, Massachusetts, 01752, Rubber Golf Tees, Model # 31021.

* cited by examiner

*Primary Examiner*—Kien T. Nguyen

(57) ABSTRACT

A golf training system whereby a user can accurately determine a plurality of swing defect types that he or she may have committed while playing the sport of golf. Moreover, the user will be able to determine many of the more common swing defect types with each stroke. An indicia creating mechanism is mounted within the swing path of the clubface of a golf club. During the swing, the indicia creating mechanism will deposit an ink mark or indicia on the clubface of the golf club. This mark will be characteristic of the type, if any, of swing defect committed. Following the swing, the user will be able to observe the indicia pattern created on the clubface and then having been made aware of any specific swing defect which may have been committed, make corrections can be made on the next swing attempt.

18 Claims, 11 Drawing Sheets

GOLF TRAINING SYSTEM

CROSS-REFERENCE TO RELATED APPLICATIONS

This application claims priority under 35 U.S.C. 119(e) on U.S. Provisional application No. 60/270,026 entitled GOLF TRAINING SYSTEM, filed on Feb. 20, 2001, by Gerard Moy.

FIELD OF INVENTION

This invention relates to golf practice devices and more specifically to a golf swing training system.

BACKGROUND OF THE INVENTION

The most important aspect of becoming a good golfer is consistency. Aspiring golfers will swing their clubs many times in order to develop a smooth, consistent swing. Notwithstanding, there are many erroneous ways or moreover, swing defects, that a practicing golfer may commit during his or her practice session. These swing defects are undesirable, and worse, the exact nature of the swing defect is not easily ascertainable.

There are several common types of swing defects that can work together in combination to cause bad shots. Conversely, the essence of a golfer's practice session is to minimize these defects on a consistent basis. There are several different defects in a person's swing that can result in the ball taking a bad path. A slice or hook occurs due to misalignment of the clubface relative to the swing direction. In other words, the clubface is not perpendicular to the intended flight path when contact is made with the golf ball. The result is that the ball initially proceeds to its intended target but due to a side rotational spin imparted by the misaligned clubface, begins to veer sideways. Also, a ball that does not make contact in the middle or "sweet spot" of the club head is known as an off-center defect. This again causes a slice or hook due to the weight of the ball at impact forcing the clubface out of alignment. Club lie is defined as the measure to how closely the bottom surface of the club head is maintained parallel to the surface of the ground. This defect, similar to the aforementioned defects can cause a side spin to be imparted to the golf ball, resulting in the shot veering off to the right or left of the target based upon the spin direction.

As described, several independent types of swing defects results in the same flight path of a golf ball. Therefore, analyzing one's swing defects cannot be ascertained by observing the flight path of the ball alone. In addition, one's swing problems cannot be totally determined by using a tool, which is only capable of measuring one type of swing defect.

During a typical practice swing, the club head will gain speeds in excess of 70 miles per hour. At these speeds, real time visual analysis of how contact is made with the ball is virtually impossible. Moreover, very slight variations in the position and orientation of the clubface during impact with the ball usually results in a large error in the resulting shot. The normal human eye does not have the capability of assessing the exact position and orientation of the clubface during impact at these speeds.

There are several conventional devices, which attempt to address this problem. One device has a writing pen mounted inside of a specially made golf club head, which leaves a mark on a sheet of paper in an attempt to give some indication of the swing. However, since the weight, length, and overall structure of this specially made golf club is different for each user, this device must be customized for each user. In addition, yet another set of clubs are required for actually playing the game of golf, which tends to be expensive.

Another approach uses a pendulum mounted golf ball mounted on a platform, so that when the golf ball is struck, the pendulum is forced onto an impact surface, which contains a flexible imaging-type material. This device is able to determine the spin imparted onto the ball during impact, however it is unable to determine the type of swing defect, which caused the spin. Also, since the golf ball in mounted on a pendulum, the user can never use this device to observe the actual flight of the golf ball and thereby correlate the flight of the golf ball to any swing defects he or she may have committed.

In another case, a lie determining device is used to show lie imperfections when the club head makes contact with the ball. This requires a specially constructed ball that could easily be lost when used on an open driving range, necessitating the need for expendable, inexpensive balls.

A strip of tape attached to the face of a golf club is used as a golf club impact recording system in another approach. This device tends to wear out after only a few swings and has to be replaced and only provides feedback on only 1 type of possible golf swing anomalies, namely an off-center defect.

Finally, a Velcro pad mounted onto the face of a golf club head has been used with a specially constructed golf ball, which also contains a Velcro surface, to determine what area of the ball the club impacts. But this device cannot be used on a real golf ball and therefore this device cannot be used during actual golf practice.

What is needed is a golf swing practice tool that can record several swing defects, such as incorrect club lie, clubface misalignment, off-center shots, and any combination of these, using real golf clubs and balls in a actual practice environment, which through extended practice and correction will automatically translate to a game of golf. The present disclosed invention describes several embodiments for meeting this need.

A number of patents may be of interest in relation to the technology discussed above and in this disclosure, including but limited to the following:

- U.S. Pat. No. 5,120,064 to Cerami, [Golfers' Swing Tracing Training Aid],
- U.S. Pat. No. 5,417,427 to Doane, [Golf Training Device],
- U.S. Pat. No. 5,609,530 to Butler, [Dynamic Lie Determination Device and Method],
- U.S. Pat. No. 5,702,309 to Lee, [Golf Training Device], and
- U.S. Pat. No. 5,142,309, [Golf Club Impact Recording System].

SUMMARY OF THE INVENTION

The present invention discloses a golf-training system comprising a marking material mounted within the swing path of a golf club for the purpose of placing a removable ink or wax mark on the face of a club head whereby a user may determine many of the more common swing defects with each practice swing. This system can be used for recording several swing defect types with each practice stroke, such as incorrect club lie, clubface misalignment relative to swing direction, off-center shots, direction of clubhead in relation to the intended direction of the golfball, and/or any combination of these aforementioned swing defects, providing accurate and concise information on all the aforementioned types of swing defects with each stroke.

The present invention results in a patterned mark or indicia created on the clubface of a golf club during a swing. The system comprises a marking material, which is mounted on a specified convex surface of a rubber golf tee or conventional golf tee, which is positioned within the swing path of a golf club. The geometrical shape of the specified convex surface in conjunction with the marking material is such that a unique marking pattern is created on the clubface indicative of the type of swing defect committed.

The disclosed indicia producing mechanism can be used with any type of golf club including irons, woods, or the like. The chemical composition of the ink or pigmented wax would be such that it will not be absorbed into the surface of the clubface and could be easily wiped clean with a rag or paper towel.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
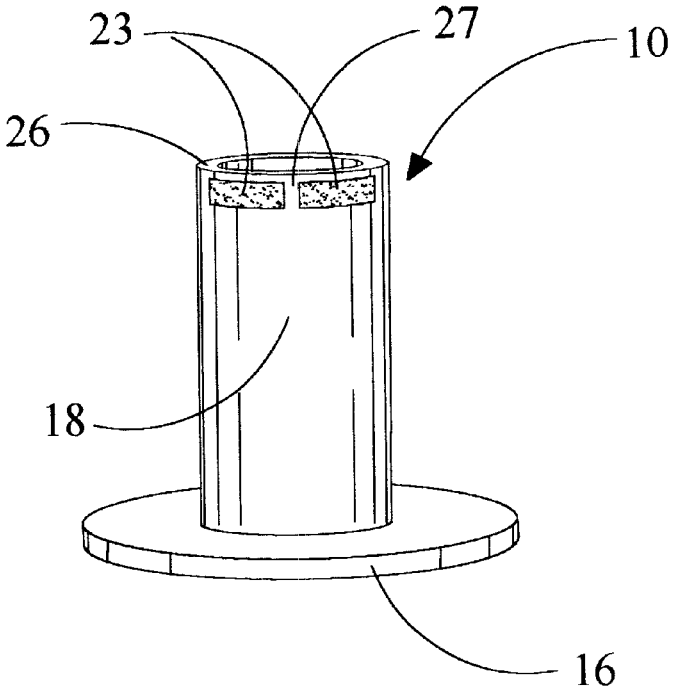
FIG. 1 is a perspective view of a first embodiment of a golf swing marking system of the present invention with two exposed marking surfaces facing forward.

The first embodiment of the present invention, shown in the drawing of FIG. 1, contains a marking medium constructed of a absorbent material 23 that is capable of transferring a marking material such as ink on to the surface of the head portion 26 of an elastic support member 18, by means of capillary action, from an ink well located in the center of the support member. The marking medium 23 together with the marking material and inkwell 25 comprise an indicia creating mechanism that provides the function of transferring a small amount of marking material such as ink on to the surface of the clubhead in order to determine several of the different types of swing defects with each swing. This embodiment of the golf training system 10 is comprised of a base 16, a cylindrical, hollow support 18 extending perpendicular in a vertical direction, out of the base, and two rectangular marking medium members 23, constructed of an absorbent material attached towards the head portion 26 of the support 18 using an adhesive means. The absorbent material used was medium density, wool felt, however any substance may be used that is sufficiently flexible, supplies ink to the marking surface via capillary action, and can withstand repeated impacts from a clubhead. The ink used was made from a blend of water, propylene glycol, and watercolor paste as a pigmenting agent, however any ink type substance may be used that will be absorbed into the marking medium and will rise to the surface of the head portion 26 via capillary action. The base 16, and cylindrical hollow support 18 are integrally formed from a single piece. The base, and support were made from vinyl, approximately shorea 60 in hardness, however this piece may be molded from any suitable plastic that will permit a large number of repeated extensions and contractions without failure.

Figure 2:
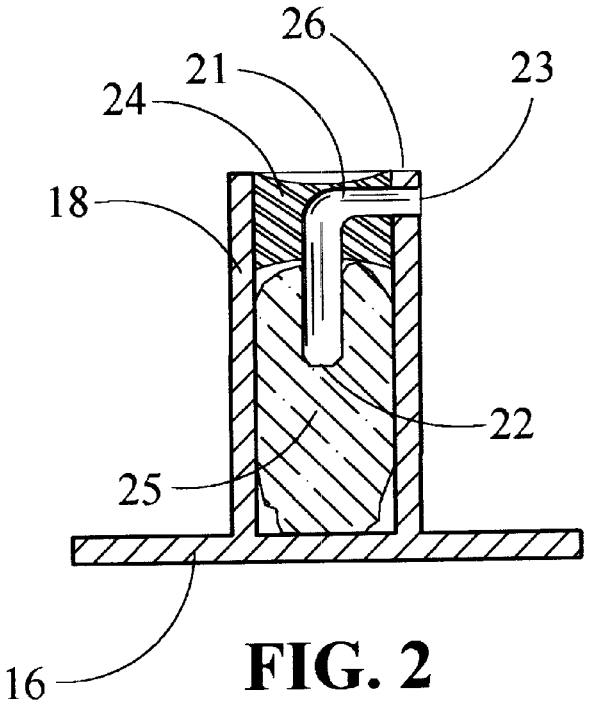
FIG. 2 is an elevation cross-sectional drawing of the golf swing marking device of FIG. 1 showing the internal structure of the present invention utilizing felt as a marking medium.

Two elongated members 21 constructed of felt defining a rectangular, solid cross-section and a proximal 22 and distal 23 end are attached to the head portion 26 of the support 18 using an adhesive 24 means with the distal end mounted flush with the sidewall 20 of the support and the proximal end 22 towards the middle of the support 18 and facing downwards, as shown in the cross-sectional drawing of FIG. 2. The exposed end 23 of both felt tips are mounted towards the head portion of the support 18 in order to form a convex marking surface with a void 27 in between. The dimension of the felt is an elongated rectangular member in shape, approximately 0.125 inch high and 0.4 inch wide, and approximately 1.4 inches long. Each elongated member is bent at a 90-degree angle so that one end is exposed at the head portion of the support 18 and the other end faces downward toward the bottom of the support. The exposed surfaces of the felt are contoured such that they are flush with the sidewall 20. An inkwell 25 composed of a small wad of fibrous cotton or other material capable of being impregnated with marking material such as ink, is positioned within the center section of the support 18. The adhesive 24 means used in this embodiment is silicone rubber, approximately shorea 30 in hardness, however any adhesive which provides sufficient elasticity in order to allow the head portion 26 to flex during impact would be a valid substitute.

Figure 3:
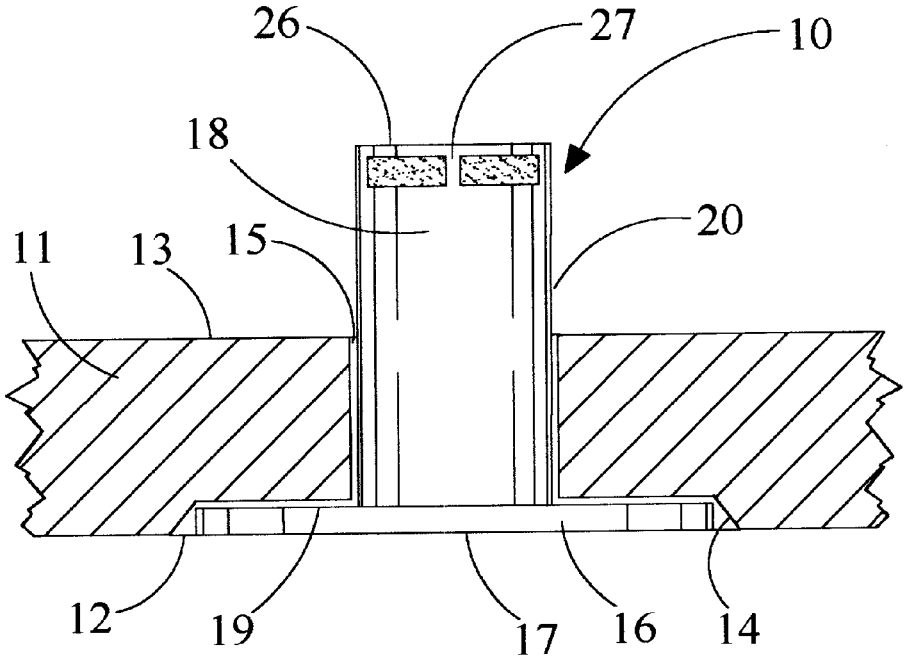
FIG. 3 is an elevation view of a first embodiment of a golf swing-marking device of FIG. 1 disposed in a golf mat aperture.

FIG. 3 is a drawing showing an operative engagement of the golf training system 10 of the first embodiment of the present invention when used in conjunction with a driving range mat 11. The driving mat 11 overlies an impenetrable rigid planar surface 12, which may be, for example, a concrete slab, asphalt or highly compacted soil. The mat 11 can be constructed of any suitable artificial surface, such as a carpet made of natural or synthetic fibers or an artificial grass surface such as ASTROTURF™ brand artificial grass available from the AstroTurf™ Corporation. This driving range mat 11 has an upper surface 13 and a lower surface 14 separated by a select distance and an aperture 15 of a select diameter extending between the upper surface 13 and the lower surface 12. The base 16 has a planar bottom 17, a top surface 19, and a cylindrical support 18 having a sidewall 20 extending upward out of the base. The base 16 has a diameter significantly greater than the diameter of the aperture 15, so that the golf training system 10 cannot be removed from the aperture 15 from the top of the mat 11.

Figure 4:
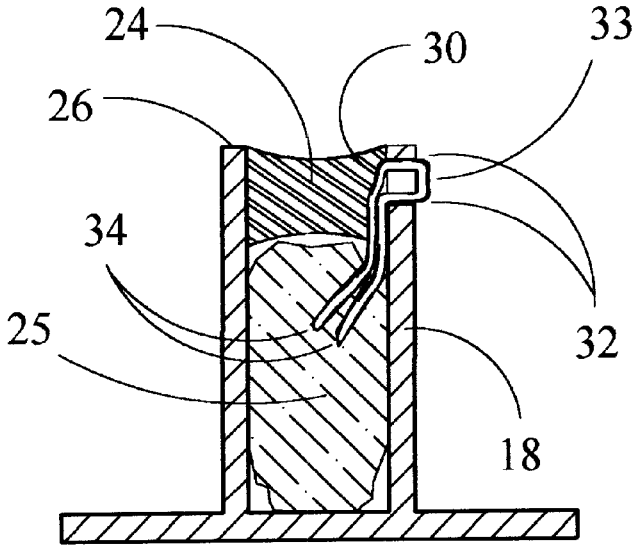
FIG. 4 is an elevation cross-sectional drawing of the golf swing marking device of FIG. 1 showing the internal structure of the present invention utilizing flexible fabric as a marking medium.

In an alternative embodiment, the marking medium may be constructed of flexible fabric 30 as shown in FIG. 4. 2 marking medium members constructed of flexible fabric 30 approximately 0.4 inches wide by 3.0 inches long and 0.02 inches thick, are each inserted through 2 slits 32 in close proximity of the head portion 26 of the support 18. The type of fabric used was woven, brushed denim was approximately 70 thread count, however any type of fabric may be used that is absorbent enough to convey ink from the ink well 25 to the head portion of the tee. The fabric is held securely against the sidewall 20 via an adhesive 24 means that maintains a constant tension on the portion of the fabric 33, which rests on the outer sidewall 20 of the support. The adhesive means used is a silicone rubber adhesive however any adhesive may be used which will adhesively connect the cloth to the inner wall of the support and is elastic enough to withstand a large number of repeated extensions and contractions. The 2 end sections of each fabric member 34 are positioned within and are in constant contact with the inkwell 25.

It is important to note that the aforementioned embodiments described 2 marking medium members, which formed a rectangular surface area conforming to the generally circular cross-section of the support 18. However, other geometrical shapes defined by the surface of the marking medium are possible such as ovals, triangles, and stripes are merely several examples of the geometric patterned indicia possible with this invention. In addition, the aforementioned embodiments describe a center section or void 27 that exists between 2 marking medium surfaces. The purpose of this void is to allow the user to easily align the golf marking device with the intended target and to create an easily identifiable indicia pattern on the face of a clubhead following a swing. Again any type of geometrical shape is possible for this void. More importantly, the geometrical cross-section of the surface of the marking medium may exist as a single entity with no void in between.

In operation, the user will mount the invention in a driving range mat similarly to the procedure done for a conventional rubber golf tee. The orientation of the tee is aligned such that the void 27 located between the 2 marking medium surfaces faces directly opposite the intended flight path of a golf ball. Next, a conventional or plastic golf ball is placed on top of the golf training system 10 and a swing taken. Following the swing, the user will observe the face of the club head and compare this to the observed flight path of the ball. The user will then be able to ascertain any swing defect or combination of swing defects committed and make swing adjustments accordingly on his or her next swing attempt.

Figure 5A:
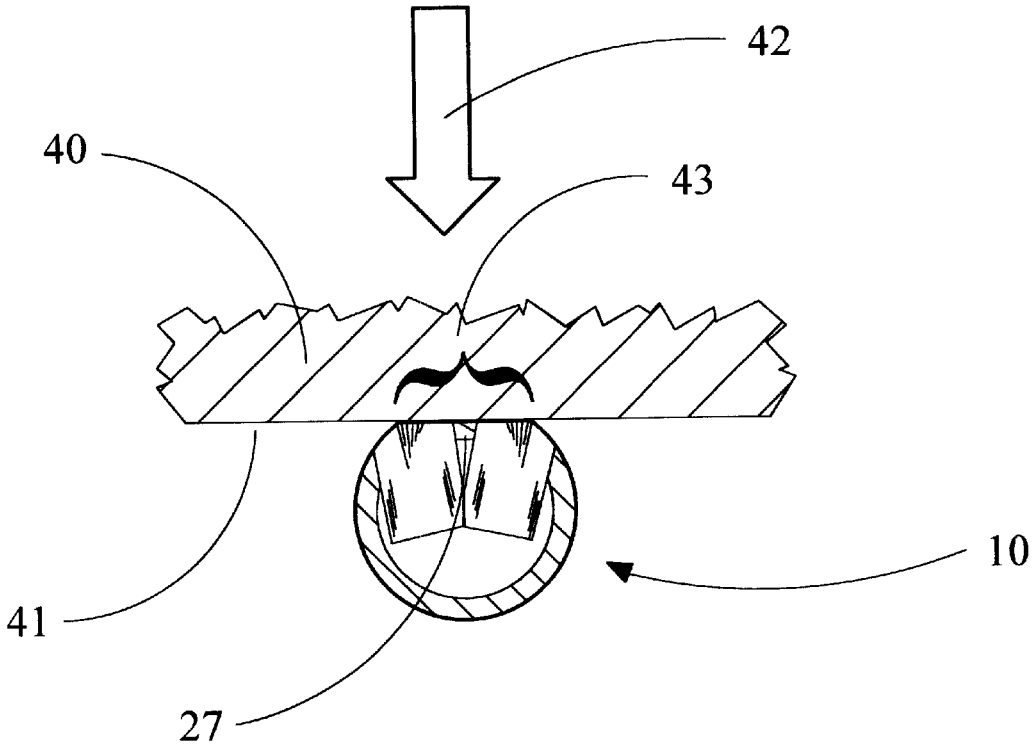
FIGS. 5A, and 5B, respectively, show how the characteristic indicia is formed on the clubface due to the clubhead impacting the golf training system of specified elasticity of the respective convex marking surface of FIG. 1 and FIG. 4.
Figure 5B:
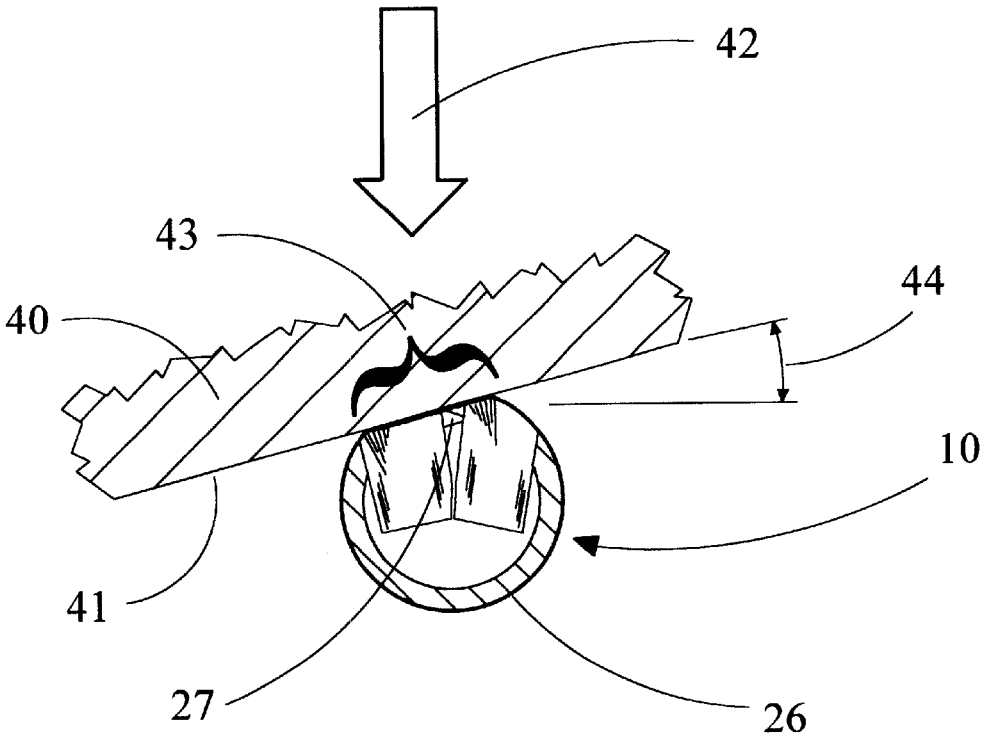
Figure 6A:
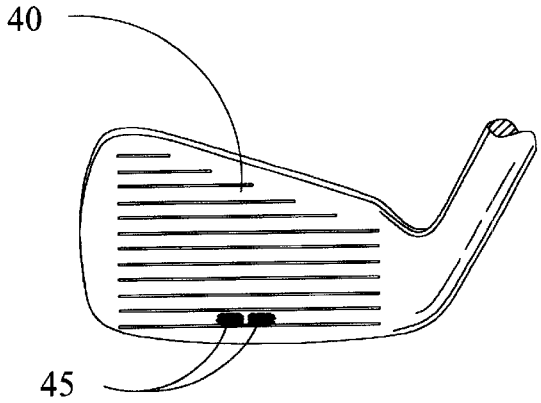
FIGS. 6A, 6B, 6C, and 6D, respectively, show different ink marks created on the face of the clubhead characteristic of the swing defect committed while using the a golf swing marking device of FIG. 1 and FIG. 4.
Figure 6B:
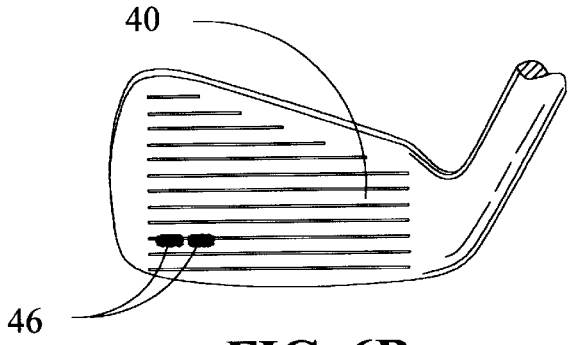
Figure 6C:
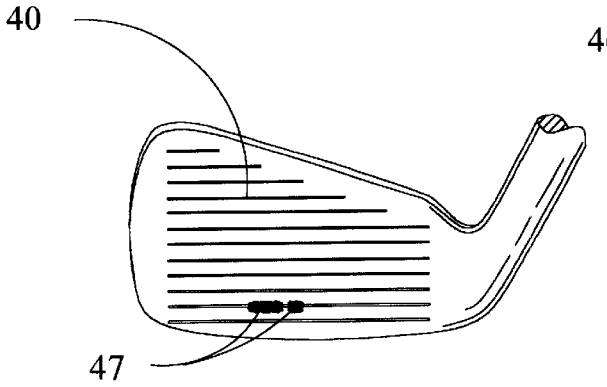
Figure 6D:
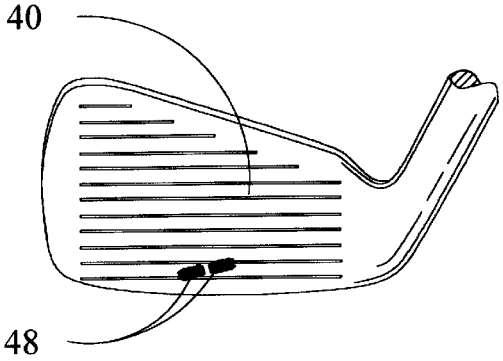
Figure 8:
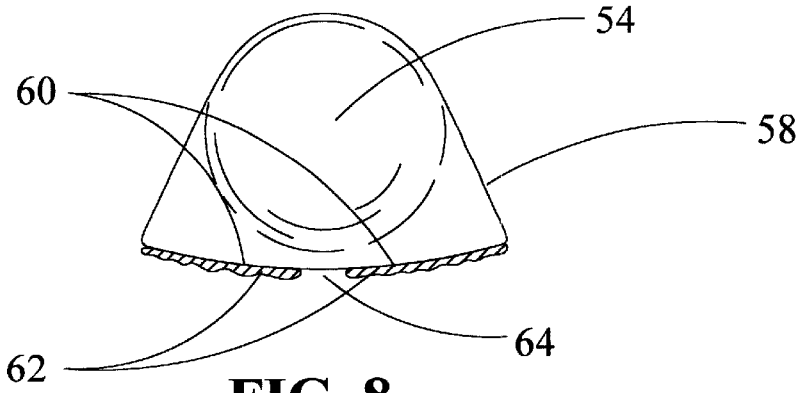
FIG. 8 is a top view of the embodiment of a golf swing marking device of FIG. 6.

The design of most golf clubs manufactured today place the "sweet spot" of the club head in the middle of the clubface of the golf club. Thus, in order to properly make contact with a golf ball resting on a golf tee, the club head must also make contact with the upper portion of the golf tee. When contact is ultimately made with the felt or fabric surfaces, a small ink pattern is placed on the face of the club head. FIGS. 5A–5B depicts how the characteristic ink pattern is created on the clubface of a golf club during impact. In FIGS. 5A–5B a top, cross-sectional, partial view of a clubhead 40 that is compacting the head portion 26 of the golf training system 10 is shown looking vertically downwards. The elasticity of the head portion 26 is specified such that only a portion 43 of the entire marking material surface comes in contact with the clubface 41. The clubface 41 is moving in a specified direction of travel 42. In FIG. 5A, due to the clubface 41 being in proper alignment with the direction of travel 42 of the clubhead 40, the indicia marks created on the clubface 41 are generally equivalent size as shown in FIGS. 6A, 6B, and 6D. In FIG. 5B the clubface 41 is misaligned with the direction of travel 42, therefore the resulting indicia created on the clubface are not equivalent in size as shown in FIG. 6C. The amount of misalignment is shown by the angle 44. The ink pattern created is characteristic of the orientation and position of the club during impact. FIGS. 6A–6D show the characteristic ink pattern placed on the club head indicative of the type of swing defect committed, as follows:

FIG. 6A shows the resulting indicia 45 created on the face of a club head 40 whereas the golf swing has been performed with no apparent swing defect. It is important to note that the resulting indicia 45 indicates multiple types of swing defects including off-center swing defect, misalignment of the clubface swing defect, and incorrect club lie; moreover, it is the lack of any of the aforementioned defects that this resulting indicia indicates. FIG. 6B shows the resulting indicia 46 created on the face of a golf club head due to an off-center swing defect. FIG. 6C shows the resulting indicia 47 created on the clubface due to a misalignment of the clubface during impact. This particular type of swing defect and the resulting indicia 47 is well known in the sport of golf as a closed-face swing. Although not shown, an open-faced swing would render the opposite type of indicia from that of a closed-face indicia 47. The indicia mark created due to an open-faced swing would cause the right side mark to be longer than the left side. It is important to note that the description of the indicia mark created due to a closed-face or open-faced swing are characteristic of a right-handed player; the opposite indicia mark is to be expected for a left-handed player. Finally, FIG. 6D shows the characteristic indicia mark 48 created on the face of a club head due to the bottom of the club head not being parallel to the surface of the ground when impact is made with the golf ball. This type of swing defect is known in the sport of golf as an incorrect club lie.

Figure 7:
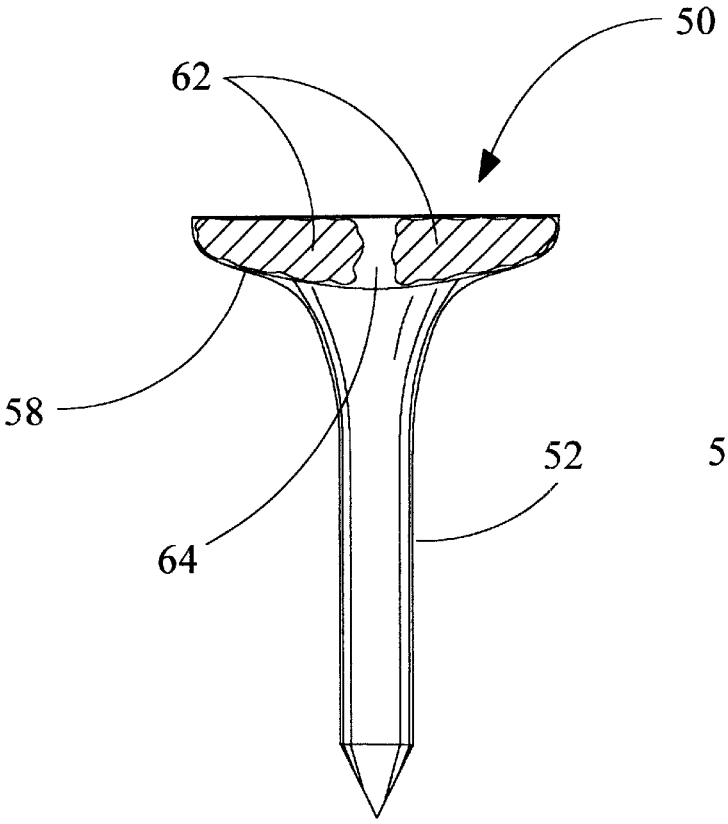
FIG. 7 is an elevation view of another embodiment of a golf swing marking device of the present invention in which a projection extends horizontally from the head of a conventional golf tee is facing forward.
Figure 9:
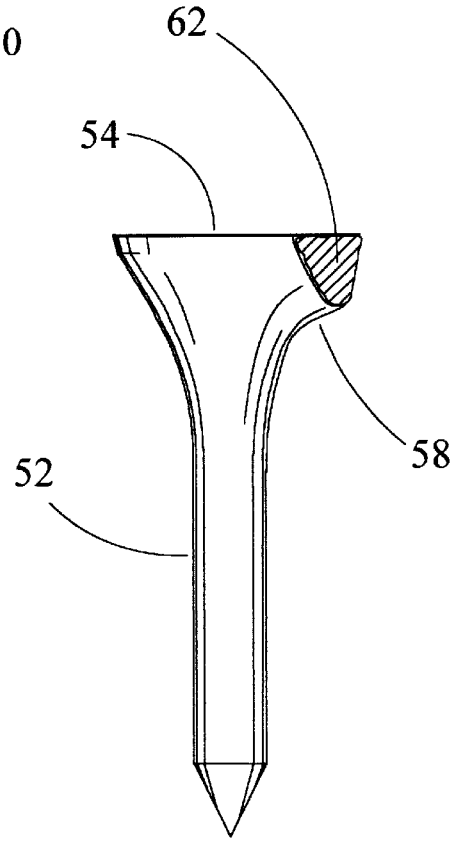
FIG. 9 is a side view of the embodiment of a golf swing marking device of FIG. 6.

Another embodiment of the present invention shown in FIG. 7 depicts an elevational view of the Golf Training System 50. The golf training system 50 is comprised of an elongated stem 52 that extends vertically from the ground under normal use, and a head 54 mounted on the upper portion of the elongated stem, which contains a concave depression on its upper extremity adapted to support a golf ball at a specified distance above the ground. A projection 58 extends outward horizontally from the head of the golf tee. The outer edge of the projection 58 creates a convex marking surface 60. Moreover, the outer edge of the projection 58 creates an arc along its vertical axis with a radius chosen such that only a portion of the surface comes in contact with the clubface during a swing. It was determined during testing that the radius of the arc approximately 1.1 inches used in conjunction with the indicia creating mechanism disposed on the surface of the arc approximately 0.045 inches thick produced optimum results. The elongated stem 52, head 54, and projection 58 are integrally formed from a single piece. This piece may be molded from any suitable plastic, wood, nylon, or the like material that can be molded into the proper shape.

An indicia creating mechanism 62 comprises a marking medium that is resilient and porous, and a marking substance such as ink that is impregnated into the marking medium. The marking medium is attached to the surface of the projection 58 using an adhesive means. The adhesive means may be any glue that does not readily absorb into the porous marking medium and is generally not ink soluble after hardening. The marking medium was constructed from foam latex available from Burman Industries in Van Nuys, Calif. The marking substance used was a blend of propylene glycol and watercolor paste however any type of ink may be used that can be impregnated into the porous foam latex and will be disposed onto the surface of the clubhead during impact. An alternative type of indicia creating mechanism 62 may be made by using an emulsion of oil based dye in hardened gelatin. The oil based dye used is opaque landscape oil color and is available at any store that sells artist supplies. The emulsion is created by adjusting the weight of the oil based die by mixing a sufficient amount of mineral oil with the dye to make the dye/oil solution suspend in the liquid gelatin. The dye/oil solution is then emulsified into the liquid gelatin using rapid agitation. When the solution is partially congealed, a thin layer approximately 0.045 inches wide is disposed on the surface 60 of the projection 58. This embodiment specified the use of ink impregnated foam latex, or oil dye emulsified in gelatin however any marking material such as ink, chalk, graphite, or pigmented, viscous paste such as lipstick that could be released on to the clubface due to the impact of the golf club during a swing would be suitable for use.

A small section approximately 0.1 inches wide defining a void 64 is oriented substantially about the center of the surface 60 of the projection 58. The entire surface 60 of the projection is covered with the marking material with the exception of the void. The purpose of the void is such that a unique geometrical pattern is created on the clubface indicative of any swing anomaly committed. Also, the void creates a means of accurately aligning the golf tee prior to attempting a golf swing using the invention.

Figure 11:
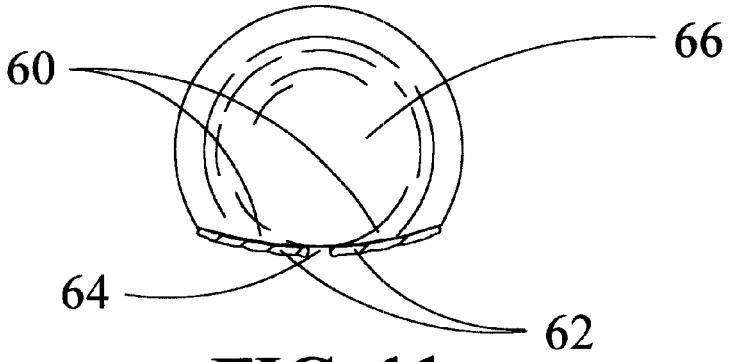
FIG. 11 is a top view of the embodiment of a golf swing marking device of FIG. 10.
Figure 10:
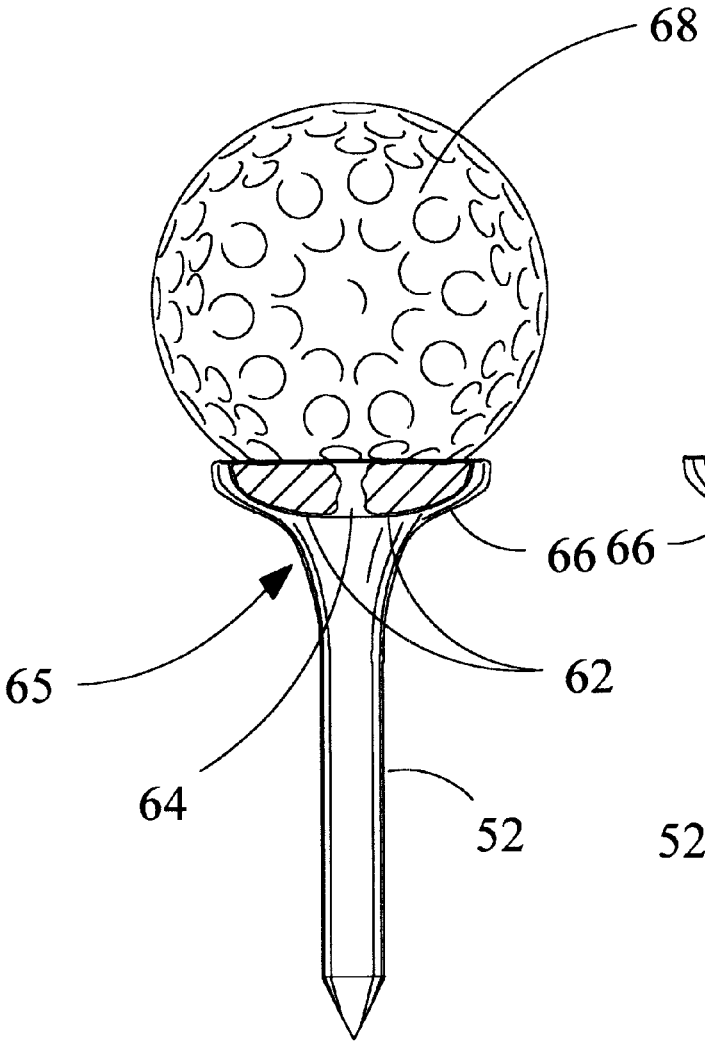
FIG. 10 is an elevation view of another embodiment of a golf swing marking device of the present invention in which a convex marking surface of specified radius is formed from the excision of a portion of the head of a golf tee in which the head of the golf tee is wider then a conventional head portion of a golf tee and is facing forward.
Figure 12:
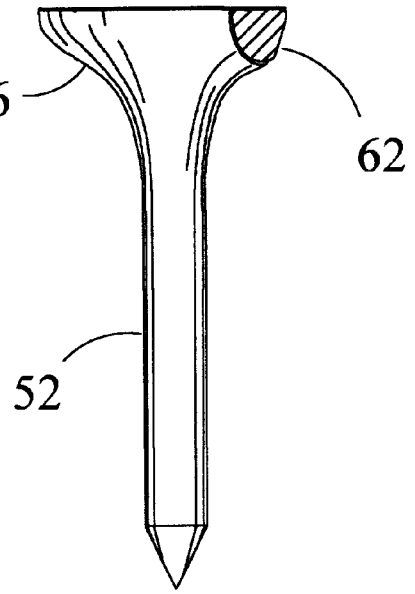
FIG. 12 is a side view of the embodiment of a golf swing marking device of FIG. 10.

The specified convex surface 60 of the aforementioned embodiment was created using a projection extending horizontally from the head portion 54 however, this convex surface 60 may also be created without a projection via a convex marking surface that is an integral portion of the head portion 54 as shown in a top view of an alternative embodiment in FIG. 11. In order to accommodate the necessary radius of the convex surface, a wider head portion then used in a conventional golf tee may be employed which is located on the upper portion of an elongated stem 52. The width of the head portion 66 must be wide enough such that an ample horizontal marking surface 60 may exists on the head portion and that a golf ball may rest on top of the head portion. A front view of this alternative embodiment of a golf training system 65 in accordance with the present invention is shown in operative engagement with a golf ball 68 resting on top of the semi-circular head portion 66 is shown in FIG. 10. A side view of this alternative embodiment is shown in FIG. 12.

Figure 13A:
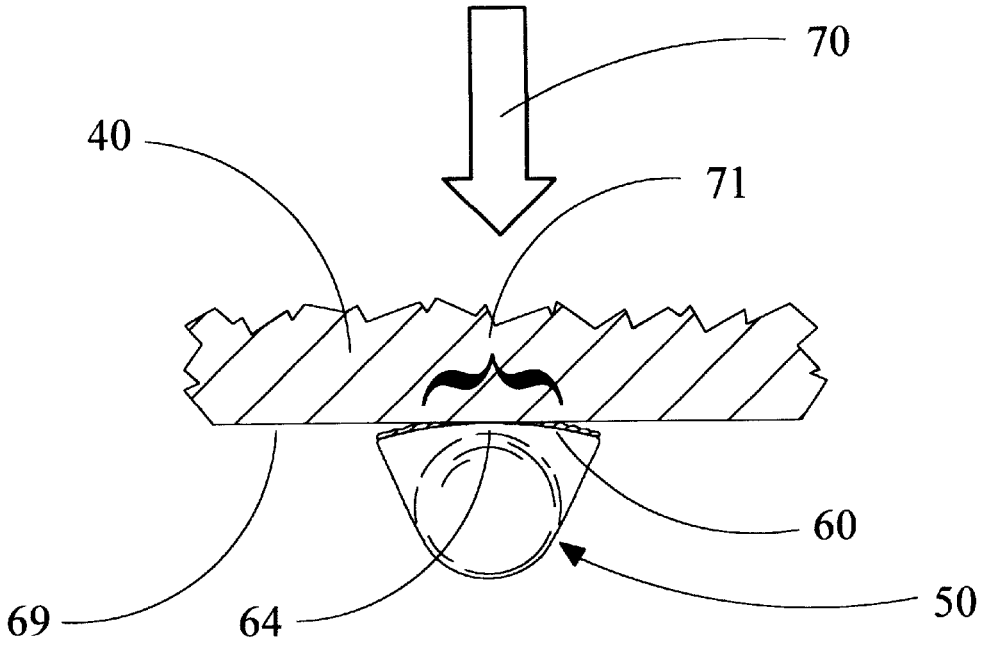
FIGS. 13A, and 13B, respectively, show how the characteristic indicia is formed on the clubface due to the clubhead impacting the golf training system of specified radius and marking material thickness of the respective convex marking surface of FIG. 7 and FIG. 10.
Figure 13B:
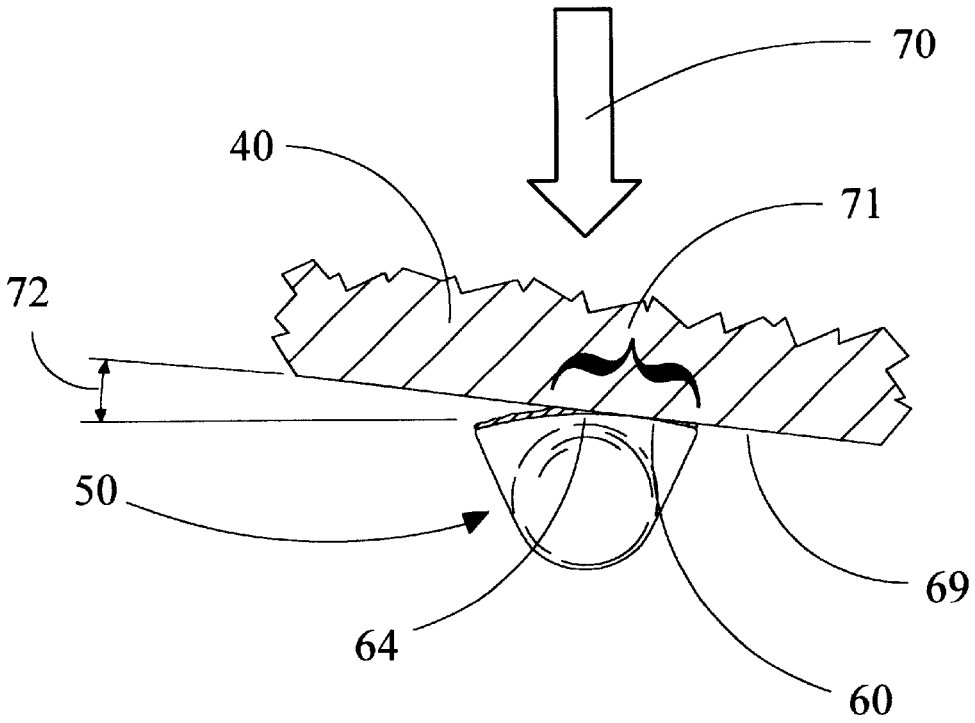
Figure 14A:
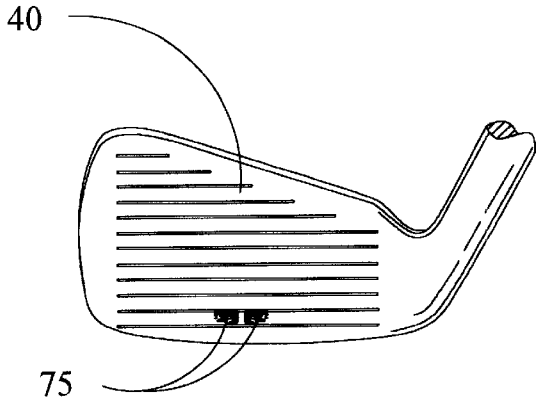
FIGS. 14A, 14B, 14C, and 14D, respectively, show different ink marks created on the face of the club head characteristic of the swing defect committed while using the a golf training system of FIG. 7 and FIG. 10.
Figure 14B:
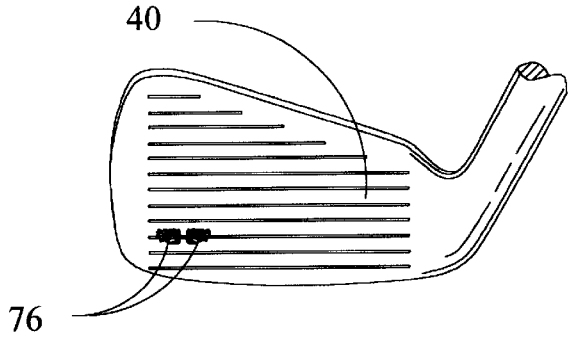
Figure 14C:
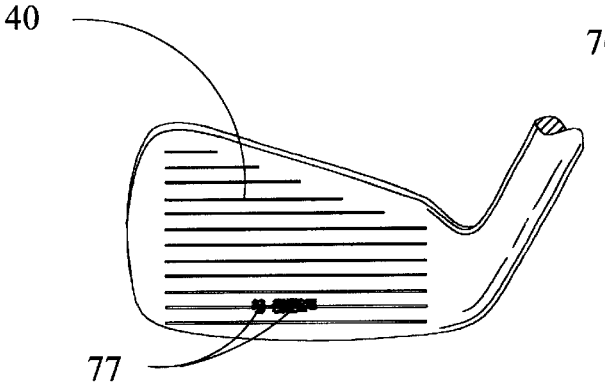
Figure 14D:
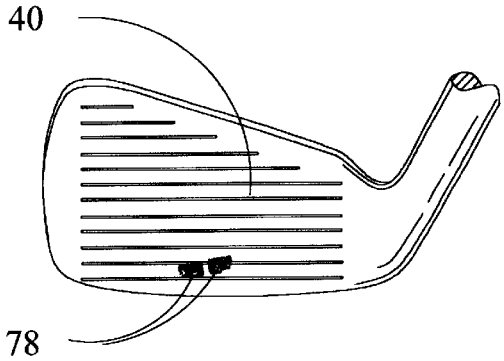

FIGS. 13A–13B depicts how the characteristic marking pattern is created on the clubface of a golf club during impact. In FIGS. 13A–13B a top, cross-sectional, partial view of a clubhead 40 that is impacting the convex surface 60 of the golf training system 50 is shown shown looking vertically downwards. The radius of the surface 60 is chosen such that only a portion 71 of the entire marking material surface comes in contact with the clubface 69 during impact. The clubface 69 is moving in a specified direction of travel 70. In FIG. 13A, due to the clubface 41 being in proper alignment with the direction of travel 70, the indicia marks created on the clubface 69 are generally equivalent size as shown in FIGS. 14A, 14B, and 14D. In FIG. 13B the clubface 69 is misaligned with the direction of travel 70, therefore the resulting indicia created on the clubface are not equivalent in size as shown in FIG. 14C. The amount of misalignment is shown by the angle 72.

To use this device the user will insert the bottom portion of the elongated stem 52 into the ground as is done with a conventional golf tee, align the surface 60 such that the void 64 is directly opposite the intended direction of the golf ball, place the golf ball upon the head of the invention, and then attempt a golf swing using his or her golf club. Following the attempted swing, the user will observe the clubface to determine if any swing anomaly has been committed. FIG. 14A depicts the resulting indicia created on the clubhead where the golf swing has been performed with no apparent swing defect. The indicia 75 created as a result of a normal swing is due to contact made with the center of the surface of the projection. It is important to note that the indicia 75 indicates multiple types of swing defects including off-center swing defect, misalignment of the clubface swing defect, and incorrect club lie; moreover, it is the lack of any of the aforementioned defects that this resulting indicia indicates. FIG. 14B depicts the resulting indicia created on the clubhead whereas the golf swing has been committed with an "off-center" swing defect. The resulting indicia 76 indicates that the clubhead made contact with the ball towards the outside portion of the clubhead. FIG. 14C depicts the resulting indicia 77 created on the clubface due to a misalignment of the clubface 40 during impact. The resulting indicia 77 shows that the portion towards the shaft of the golf club has made contact with the surface 60 earlier than the other side. FIG. 14D depicts a swing which was performed using an incorrect club lie defect. As shown, the resulting indicia 78 is not parallel with the bottom of the club face.

Figure 16:
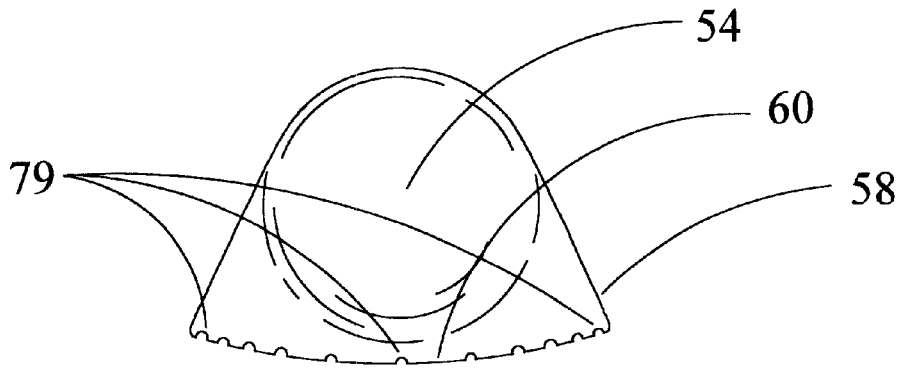
FIG. 16 is a top view of another embodiment of a golf swing marking device of FIG. 15.
Figure 15:
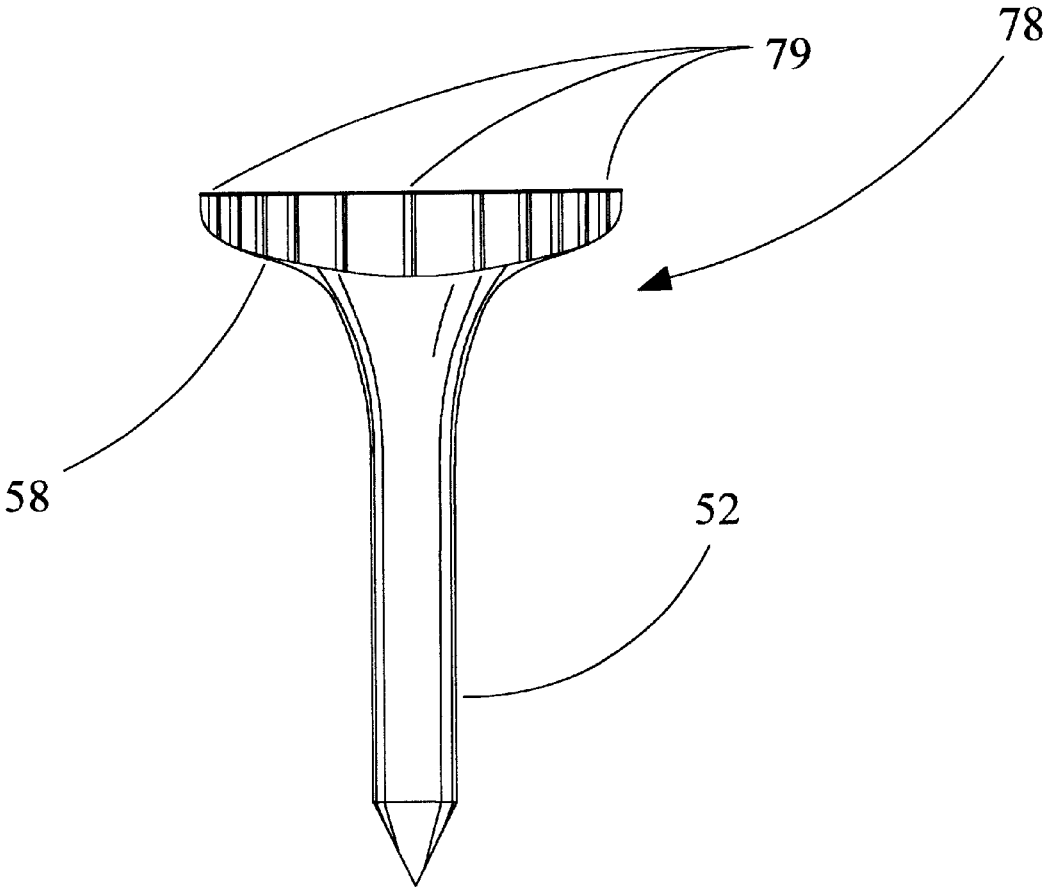
FIG. 15 is an elevation view of another embodiment of a golf training system of the present invention in which a convex marking surface of specified radius has grooves located on said marking surface for the creation of characteristic indicia on golf club tape which is releasably attached to the surface of the clubface in which said specified marking surface is facing forward.

The marking material used in the previous embodiment was disposed on the surface 60 of the projection however marking tape, which contains microcapsules that is releasably disposed on a special tape which can be releasably attached to the clubface may be used as the marking medium. The clubhead tape described in U.S. Pat. No. 5,142,309, to Lee, issued Aug. 25, 1992 describes a means of creating indicia indicative of impact location on the clubhead using embedded microcapsules disposed within a releasably adhesive substance, is hereby incorporated by reference. Alternatively, to the aforementioned embodiment, the surface 60 of the projection may contain grooves 79 which extend vertically from the top to the bottom of the surface 60 and are spaced a specified distance apart are shown in FIG. 16. The grooves 79 are spaced progressively closer together in relation to their distance from the center of the surface 60 of the projection. In this embodiment, the grooves 79 toward the center of the surface 60 are spaced approximately 0.2 inches apart and the grooves toward the outer edge of the surface 60 are spaced approximately 0.062 inches apart.

The use of this device encounters placing the aforementioned clubhead tape on the clubhead, inserting the bottom portion of the elongated stem 52 into the ground, aligning the tee such that the surface 60 of the projection is directly opposite the intended direction of the golf ball, and placing a golf ball upon the head of the invention. Next, a swing is attempted at the golf ball. In order to create the necessary pressure on the clubhead tape to cause the embedded microcapsules to burst, the tee should be pressed into the ground approximately twice as far as what is done for a conventional golf tee. Following the wing the user observes the clubhead tape to determine if any swing anomalies have been created. Possible swing anomalies and their associated indicia patterns created by the present invention are shown in FIGS. 17A–17D.

Figure 17A:
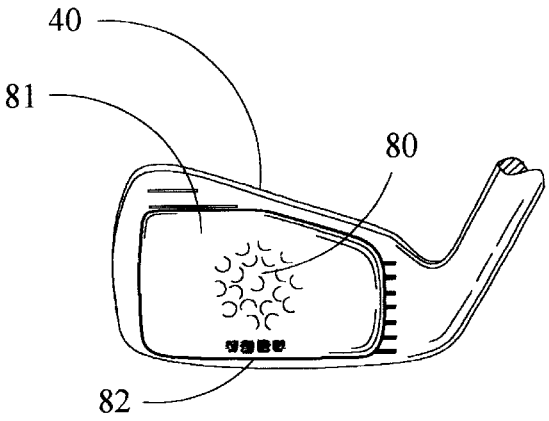
FIGS. 17A, 17B, 17C, and 17D, respectively, show different indicia created on golf club marking tape characteristic of the swing defect committed while using the a golf swing marking device of FIG. 15.
Figure 17B:
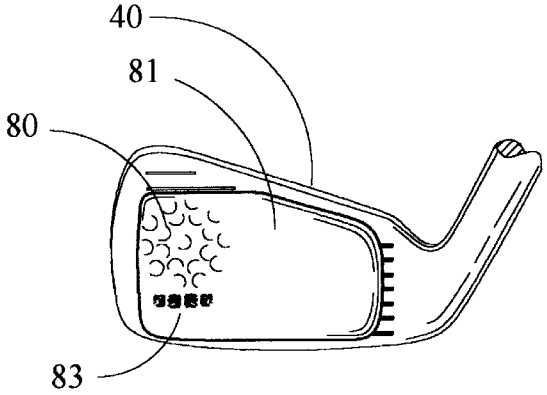
Figure 17C:
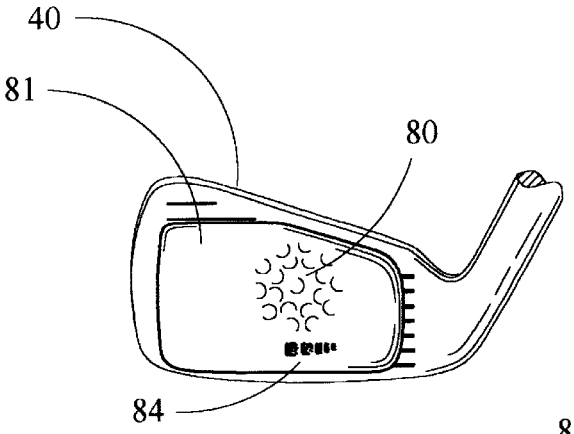
Figure 17D:
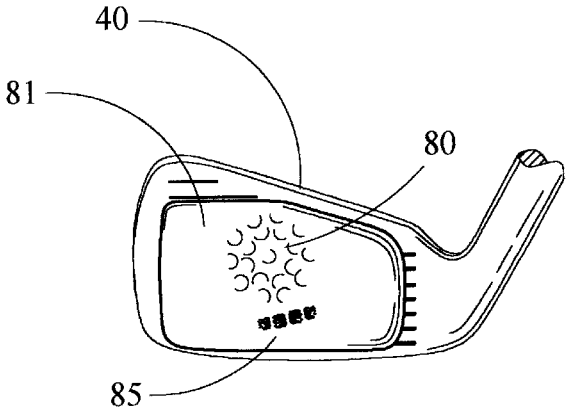

FIG. 17A depicts the resulting indicia created on the clubhead tape 81 where the golf swing has been performed with no apparent swing defect. The indicia 82 created as a result of a normal swing is due to contact made with the center of the surface of the projection. It is important to note that the resulting indicia 82 indicates multiple types of swing defects including off-center swing defect, misalignment of the clubface swing defect, and incorrect club lie; moreover, it is the lack of any of the aforementioned defects that this resulting indicia indicates. FIG. 17B depicts the resulting indicia created on the clubhead tape 81 where the golf swing has been committed using an "off-center" swing defect. The resulting indicia 83 indicates that the clubface made contact with the ball towards the outside portion of the clubhead. FIG. 17C depicts the resulting indicia 84 created on the clubface due to a misalignment of the clubface of the clubhead 40 during impact. The resulting indicia 84 shows that the portion towards the shaft of the golf club has made contact with the surface 60 earlier than the other side of the surface. FIG. 17D depicts a swing that was performed using an incorrect club lie defect. The resulting indicia 85 is not parallel with the bottom of the clubface.

Figure 18:
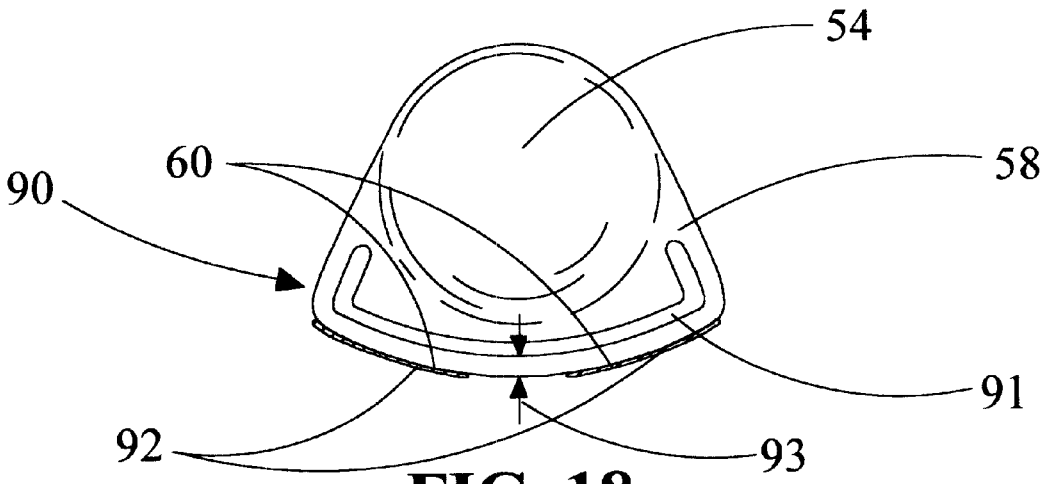
FIG. 18 is a top view of another embodiment of the golf Training System of the present invention.
Figure 19:
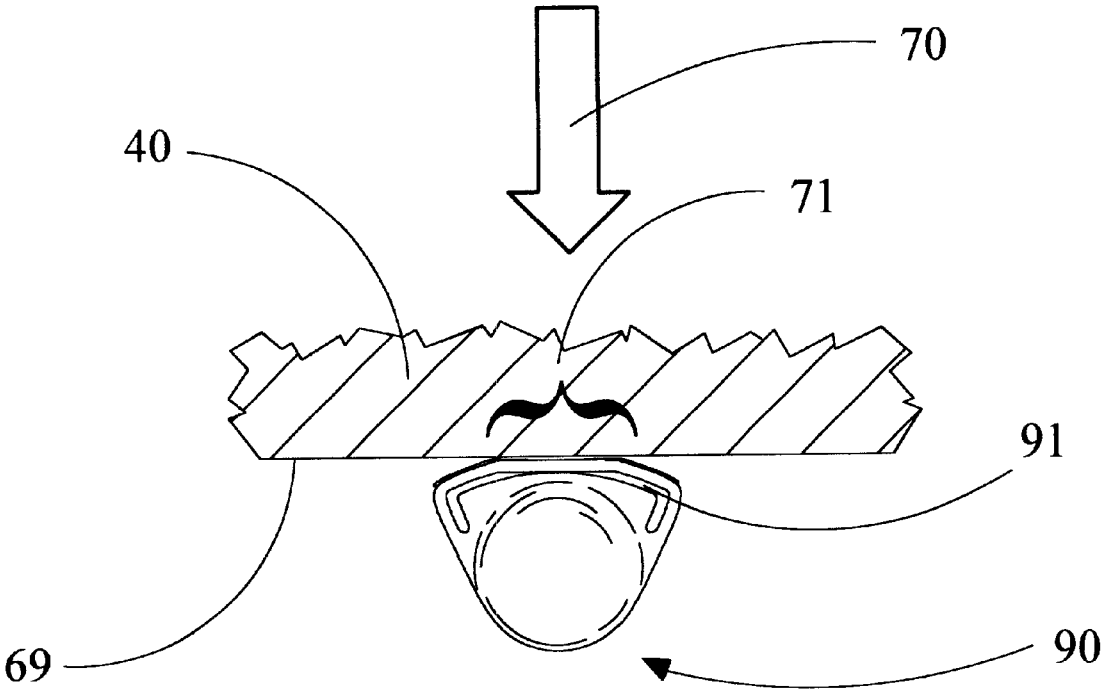
FIG. 19 show how the characteristic indicia is formed on the clubface due to the clubhead impacting the golf swing marking system of FIG. 18.

Although the previous embodiments teach the use of an indicia creating mechanism 62 of specified thickness in order that only a portion 71 of the said surface comes in contact with the clubhead during contact, the projection 58 may be modified via a slit 91, a specified distance 93 behind the convex marking surface 60, in order to create a resilient surface as shown in FIG. 18. FIG. 18 depicts a top view of an alternative embodiment of the Golf Training System 90. The structure of this embodiment is constructed similar to the previous embodiments, however a slit 91 defining an elongated void approximately 0.05 inches thick could exist a specified distance 93 behind the convex marking surface 60 in order to make the convex marking surface resilient. The purpose of this resiliency is to cause a portion of the convex marking surface 60 to conform to the flat surface of the clubhead 40 during impact and thus transform a specified indicia pattern onto the surface of the clubhead during impact. The marking material may be constructed of a viscous, pigmented paste from a blend of dehydrated corn syrup, propylene glycol, and watercolor paste. The watercolor paste is used as a pigment and may be obtained from any artist supply store. To form the indicia creating mechanism 92, a thin layer of hardened gelatin may be disposed on the surface of the marking material such that the marking material may remain inert during normal handling. A blend of dehydrated corn syrup, propylene glycol, and watercolor paste was taught in this example however any substance may be used in which the viscosity of the mixture remains sufficiently tacky in order to adhere to the face of the clubhead and sufficiently dense to not flow under varied ambient temperature conditions. FIG. 19 depicts how the characteristic marking pattern is created by the Golf Training System 90 on the clubface of a golf club during impact. The clubhead 40 is moving in direction 70 towards the Golf Training System 90. The convex marking surface 60 is sufficiently resilient such that only a portion of said surface comes in contact with the clubhead 69 during impact. A material of plastic or nylon with hardness of approximately shored 35 to 95 could be used such that the entire structure of the tee remains rigid except for the convex marking surface 60 which would be sufficiently resilient to allow warping of a portion of the surface 60 to conform to the contour of the clubhead 40 during impact.

While this invention has been described in the context of a few preferred embodiments, it will be apparent to those skilled in the art that the present invention may be modified in numerous ways and may assume embodiments other than that specifically set out and described above. Accordingly, it is intended by the appended claims to cover all modifications of the invention that fall within the true spirit and scope of the invention.

What is claimed is:

1. A golf training system for recording a golf clubhead orientation at which said clubhead of golf club impacts a golf ball, said apparatus comprising:

a head portion having an upward concaved socket portion for supporting a golf ball;

a support portion extending from said portion, which suspends said head portion a specified distance from the ground;

a projection, which extends outward horizontally from said head portion and is attached to the side of said portion, said projection having an outer edge defining a convex marking surface, defined by a horizontally oriented semi-circular arc, wherein the radius of said arc is chosen such that only a specified portion of said marking surface comes in contact with said clubhead during impact;

an indicia creating mechanism, which is disposed essentially only on said convex marking surface which is transferred to the clubface of said golf clubhead at impact, thereby creating an indicia mark characteristic of said orientation, whereby the user will be able to determine a plurality of swing defect types with each stroke.

2. The golf training system of claim 1, wherein said support is an elongated stem portion extending from said head portion for penetration into and support from the ground.

3. The golf training system of claim 2, wherein said indicia creating mechanism is made from ink impregnated foam latex.

4. The golf training system of claim 2, wherein said indicia creating mechanism is made from a coating of oil dye emulsified in gelatin.

5. The golf training system of claim 2, wherein said indicia creating mechanism is made from viscous pigmented paste.

6. The golf training system of claim 2, wherein said support portion, head portion, and convex marking surface are integrally made from a substance selected from the group consisting of wood, plastic, and nylon.

7. The golf training system of claim 1, wherein swing defect is selected from the group consisting of location at which said clubface of golf club makes contact with said golf ball, the direction at which golf clubhead is traveling in relation to the intended direction of the golf ball, incorrect club lie, and misalignment of the clubface relative to the swing direction.

8. A golf training system for recording a golf clubhead orientation at which said clubhead of golf club impacts a golf ball, said apparatus comprising:

a head portion having an upward concaved socket portion for supporting a golf ball;

an elastic support portion extending from said head portion, which suspends said head portion a specified distance from the ground, wherein said support portion is made from an elastic material;

a base, which suspends said elastic support portion from the ground in a substantially vertical position;

a convex marking surface, defined by a horizontally oriented semi-circular arc, which is attached to the side of said head portion, wherein the radius of said arc is chosen such that only a specified portion of said marking surface comes in contact with said clubhead during impact;

an indicia creating mechanism, which is disposed essentially only on said convex marking surface, which is transferred to the clubface of said golf clubhead at impact, thereby creating an indicia mark characteristic of said orientation, whereby the user will be able to determine a plurality of swing defect types with each stroke.

9. The golf training system of claim 8, wherein said convex marking surface is an integral portion of said support portion.

10. The golf training system of claim 8, wherein said indicia creating mechanism is made from ink, which is saturated on the surface of;

a marking medium, which replenishes said ink to said convex surface via capillary action.

11. The golf training system of claim 10, wherein said marking medium is made from felt.

12. The golf training system of claim 10, wherein said marking medium is made from flexible fabric.

13. The golf training system of claim 8, wherein said support portion, head portion, and convex marking surface are integrally made from a substance selected from the group consisting of rubber, plastic, and vinyl.

14. A golf training system for recording a golf clubhead orientation at which said clubhead of golf club impacts a golf ball, said apparatus comprising:

a head portion having an upward concaved socket portion for supporting a golf ball;

a support portion extending from said head portion, which suspends said head portion a specified distance from the ground;

a marking surface means, which is attached to the side of said head portion, wherein only a specified portion of said marking surface comes in contact with said clubhead during impact;

an indicia creating means, which is disposed on said marking surface means, which is transferred to the clubface of said golf clubhead at impact, thereby creating an indicia mark characteristic of said orientation, whereby the user will be able to determine a plurality of swing defect types with each stroke.

15. The golf training system of claim 14, wherein said support portion is made from an elastic material;

a base, which suspends said elastic material from the ground in a substantially vertical position.

16. The golf training system of claim 14, wherein said support portion is an elongated stem portion extending from said head portion for penetration into and support from the ground.

17. The golf training system of claim 14, herein swing defect is selected from the group consisting of location at which said clubface of golf club makes contact with said golf ball, the direction at which golf clubhead is traveling in relation to the intended direction of the golf ball, incorrect club lie, and misalignment of the clubface relative to the swing direction.

18. A method for determining a plurality of possible swing defects committed following each stroke comprising:

providing a golf tee having a head portion having an upward concaved socket portion for supporting a golf ball, a support portion extending from said head portion, which suspends said head portion a specified distance from the ground, a convex marking surface, defined by a horizontally oriented semi-circular arc which is attached to the side of said head portion, wherein the radius of said arc is chosen such that only a specified portion of said marking surface comes in contact with said clubhead during impact, an indicia creating mechanism, which is disposed on said convex marking surface, which is transferred to the clubface of said golf clubhead at impact, thereby creating an indicia mark characteristic of said orientation;

mounting said golf tee securely to the ground;

swinging at the golf ball with a golf club so that the golf club face impacts the golf ball and the golf tee, leaving a marking on the clubface of a golf club; and observing the indicia created on the clubhead to determine a plurality of possible swing defect types which may have been committed with each stroke.

* * * * *